US008388013B2

(12) United States Patent
Indulti

(10) Patent No.: US 8,388,013 B2
(45) Date of Patent: Mar. 5, 2013

(54) HEEL PIECE FOR AN ALPINE SKI ATTACHMENT

(75) Inventor: Giovanni Indulti, Pianoro (IT)

(73) Assignee: ATK RACE S.r.l., Fiorano Modense (Modena) (IT)

( * ) Notice: Subject to any disclaimer, the term of this patent is extended or adjusted under 35 U.S.C. 154(b) by 177 days.

(21) Appl. No.: 13/008,144

(22) Filed: Jan. 18, 2011

(65) Prior Publication Data

US 2011/0175328 A1 Jul. 21, 2011

(30) Foreign Application Priority Data

Jan. 19, 2010 (IT) ..... BO2010A0027

(51) Int. Cl.
*A63C 9/00* (2006.01)

(52) U.S. Cl. ..... 280/623; 280/626; 280/627; 280/628; 280/629

(58) Field of Classification Search ..... 280/625, 280/613, 627, 628, 631, 634, 614, 623, 626, 280/629
See application file for complete search history.

(56) References Cited

U.S. PATENT DOCUMENTS 3,241,849 A * 3/1966 Bodycomb ..... 280/623
3,514,118 A * 5/1970 Baccheschi ..... 280/628
3,630,538 A * 12/1971 Klein et al. ..... 280/623
3,909,029 A * 9/1975 Salomon ..... 280/628
4,008,907 A * 2/1977 Murata ..... 280/614
4,261,595 A * 4/1981 Smialowski et al. ..... 280/614
4,319,767 A * 3/1982 Emilson ..... 280/614
4,444,412 A * 4/1984 Callegari ..... 280/614
4,971,351 A * 11/1990 Flick ..... 280/625

FOREIGN PATENT DOCUMENTS

AT 402020 B 1/1997
WO WO2009/105866 A 9/2009

OTHER PUBLICATIONS

European Search Report for corresponding EP application 11 15 1042, dated Apr. 15, 2011 (2 pages).

* cited by examiner

*Primary Examiner* — Hau Phan
(74) *Attorney, Agent, or Firm* — William J. Sapone

(57) ABSTRACT

A heel piece for an alpine ski attachment comprises a base element (1), fastenable to a ski (S), an upper element (2), coupled to the base element (1), and a pair of rotatable arms for hooking to a shaped portion exhibited in a rear part of an alpine ski boot. A pair of pins (32) borne by the arms (31) project from the upper element (2). An elastic element (4) maintains the pins (32) at a predetermined reciprocal distance. The elastic element is stressed by a separation of the pair of pins (32), determined by a lowering of the ski boot onto the ski and by insertion between the pins (32) of the shaped portion. The pins (32), following complete insertion of the shaped portion between the pins, lock against an upper part of the shaped portion to hook the ski boot.

11 Claims, 3 Drawing Sheets

HEEL PIECE FOR AN ALPINE SKI ATTACHMENT

FIELD OF THE INVENTION

The present invention relates to the technical sector regarding equipment for winter sports, in particular ski attachments usable for Alpine skiing.

DESCRIPTION OF THE PRIOR ART

Alpine skiing is a sporting discipline in which the athlete re-ascends using the skis, from a point downhill up to a predetermined point from which he or she will newly descend with the skis, either on- or off-piste, using conventional skiing techniques.

In order to enable re-ascent with skis attached, without sliding backwards, sealskins are applied to the underneath of the skis, while the attachments and ski-boots have to be specially conformed in order to enable the athlete to unhook the rear part of the ski-boot, while the front part stays anchored to the ski.

The attachments usually comprise a toe-piece and a heel-piece, both fixable to the ski.

Ski-boots usable for practicing Alpine skiing have, at the front part thereof, seatings associated to blocking means present in the toe-piece, while in the rear part they exhibit a portion or plate specially shaped such as to be inserted and blocked in the hooking means present in the heel-piece.

In order to be able to perform the ascent part with skis attached, as mentioned above, the athlete has to have the boots constrained only at the front part thereof, at the toe-piece, while the rear part of the boots must be freed from the heel-piece of the attachment.

Before descending, though, the athlete must hook the rear part of his or her boots to the heel-piece of the ski attachment.

A particularly relevant requirement in the specific technical sector of attachments for Alpine skiing relates to the possibility of supplying the athlete with attachments that are progressively aimed at improving sporting performance and which therefore, are not only of modest size and weight, but which are also especially compact and light.

SUMMARY OF THE INVENTION

The aim of the present invention is therefore to provide a heel-piece, usable for an attachment for Alpine skiing which is compact, having a contained size and weight.

In particular, the aim of the present invention is to provide a heel-piece which is usable for an Alpine ski attachment.

The proposed heel-piece of the present invention exhibits hooking means of the boot which comprise a pair of arms, rotatably constrained to the upper element, and a pair of pins borne by the pair of arms in such a way as to project from the upper element and to be facing towards a front part of the ski, and is further provided with elastic means associated to the upper element 2 in such a way as to be in contact with the pins and to maintain the pins at a predetermined reciprocal distance; the elastic means recalling the pins such that they near one another when they have been forced to distance by insertion of the shaped portion present in the rear part of the boot between the pins, in order to lock against an upper part of the shaped portion and thus to hook the ski boot.

With a thus-arranged structure, the heel-piece exhibits only the two pins that project from the upper element, which pins are facing towards the front part of the ski in order to hook the boot; the heel piece therefore advantageously exhibits a particularly contained and modest volume.

Other characteristics of the heel-piece for an Alpine ski attachment of the present invention are set out in the various dependent claims.

BRIEF DESCRIPTION OF THE DRAWINGS

The characteristics of the heel-piece for an Alpine ski attachment of the present invention will be set out in detail in the following description, made with reference to the accompanying figures of the drawings, in which:

FIG. 3 is a front view of the heel-piece of the invention, while

FIG. 5 is a lateral view of the heel-piece of the invention, while

DESCRIPTION OF THE PREFERRED EMBODIMENTS

With reference to the accompanying figures of the drawings, reference T relates to a heel-piece for an Alpine ski attachment proposed with the present invention.

The heel-piece T comprises a base element 1 which is fastenable by fastening means of known type to a ski S usable for Alpine skiing, an upper element 2, coupled to the base element 1, and hooking means 3 which are borne by the upper element 2 for hooking with a shaped portion that is usually present in the rear part of a ski-boot for Alpine skiing.

Figure 1:
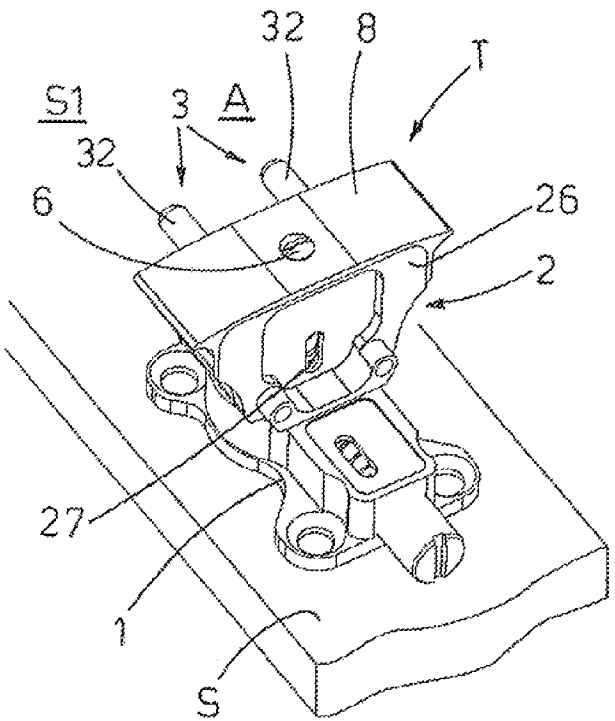
FIG. 1 is a perspective view of the heel-piece of the present invention, fixed to a relative Alpine-type ski and in a hooking position for a ski-boot.

The upper element 2 is coupled to the base element 1 by known means such that the hooking means 3 are facing towards the front part SI of the ski S for hooking with the boot (the hooked position A illustrated in FIG. 1).

For example, in a possible embodiment, the upper element 2 can be coupled to the base element 1 in such a way as to be rotatable with respect to the base element 1 and maneuverable by the athlete between at least the hooking position A, in which the hooking means 3 are facing towards the front part S1 of the ski S for hooking with the shaped portion of the rear part of the boot, and an unhooked position in which the hooking means 3 are facing in a transversal direction to the ski S, for unhooking the boot.

The peculiarities of the heel-piece T consist in the fact that the hooking means 3 comprise a pair of arms 31 which are constrained to the upper element 2 in such a way as to be rotatable with respect thereto and a pair of pins 32 borne by the pair of arms 31 such as to project from the upper element 2.

Figure 2:
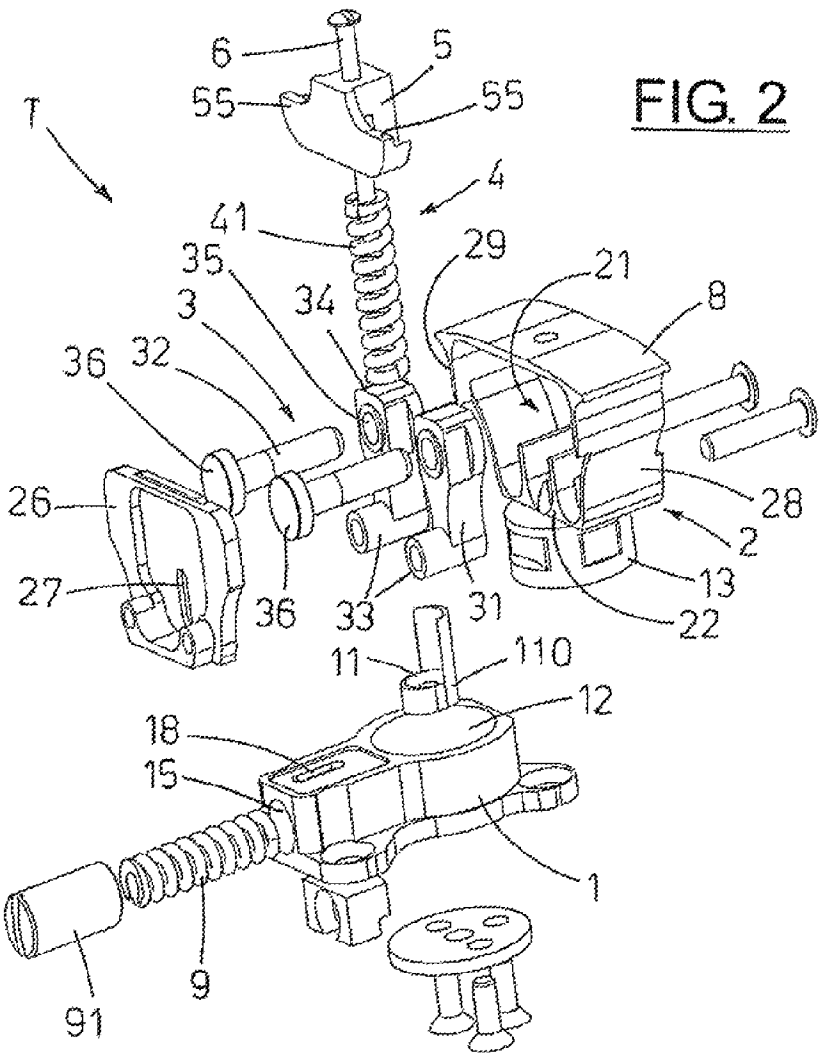
FIG. 2 is an exploded perspective view of the various components of the heel-piece proposed with the present invention.
Figure 6:
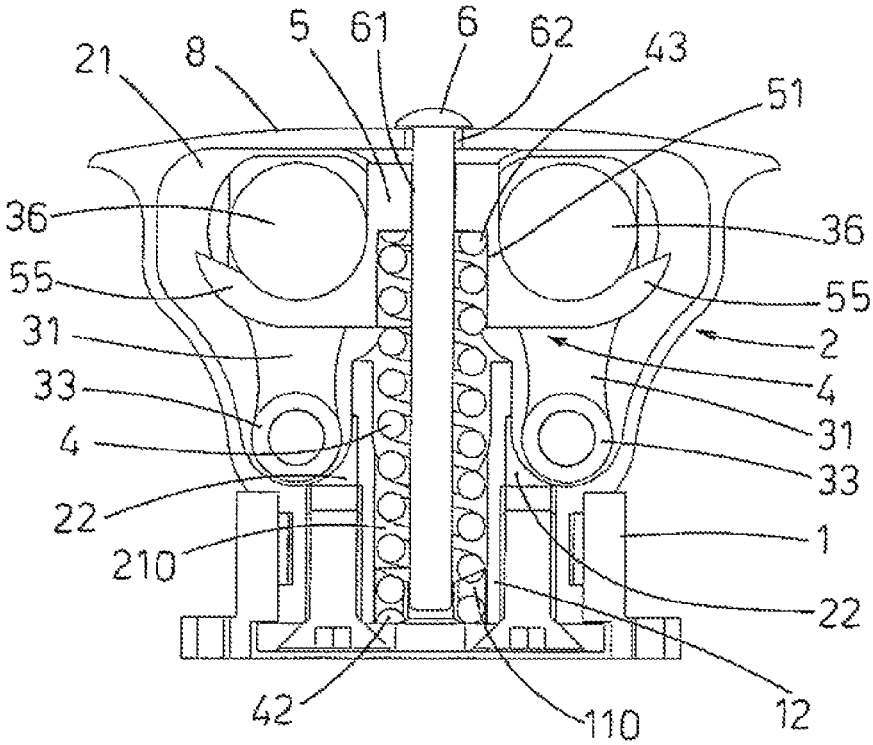
FIG. 6 is a view along section line VI-VI of FIG. 5.

For example, as illustrated in the accompanying figures of the drawings, in particular FIGS. 2 and 6, the arms 31 are constrained to the upper element 2 in such a way as to be rotatable in a perpendicular plane to the base element 1.

The pair of pins 32 is borne by the pair of arms 31 in such a way that both the pins 32 are facing towards the front part S1 of the ski S for hooking the boot (see FIG. 1).

Further, the heel-piece T is provided with elastic means 4 that are associated to the upper element 2 such as to be in contact with the pins 32 of the pair of pins 32 and to maintain them at a predetermined mutual reciprocal distance.

Figure 3:
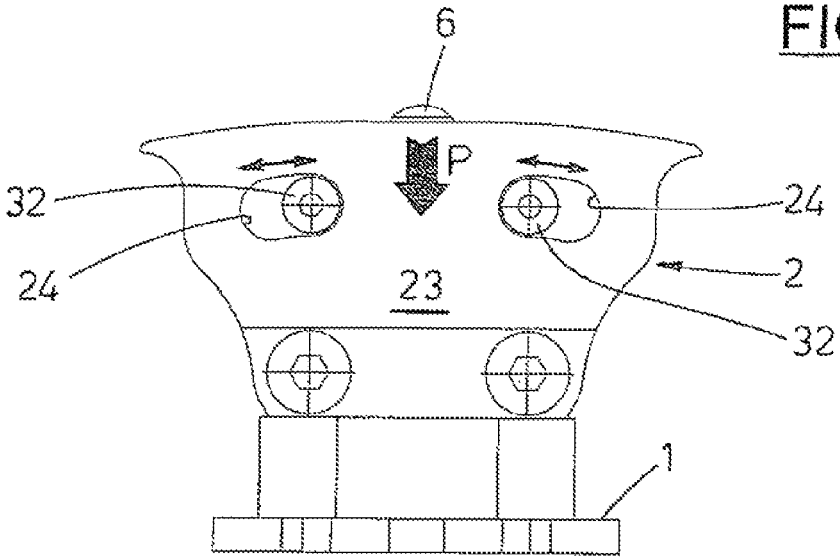
Figure 4:
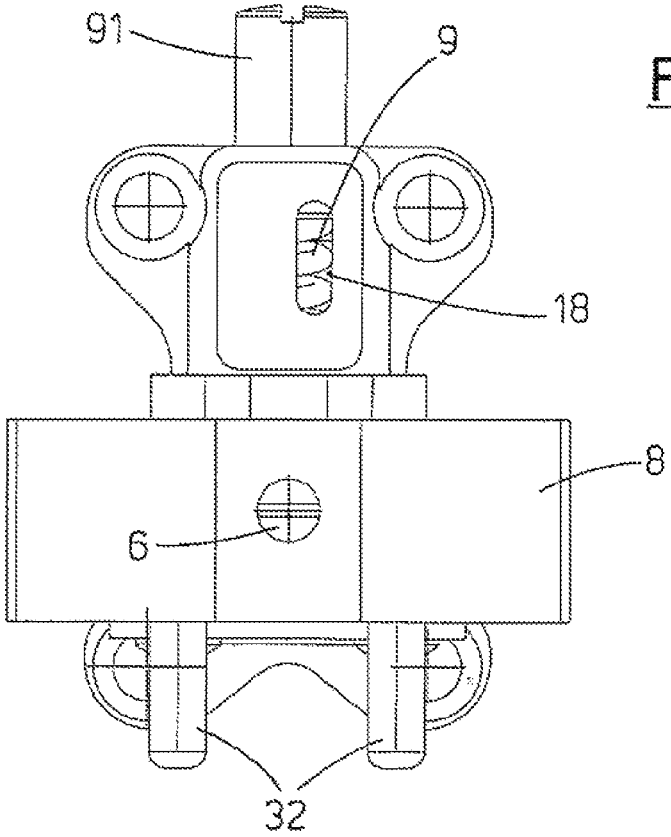
FIG. 4 is a plan view of the heel-piece.
Figure 5:
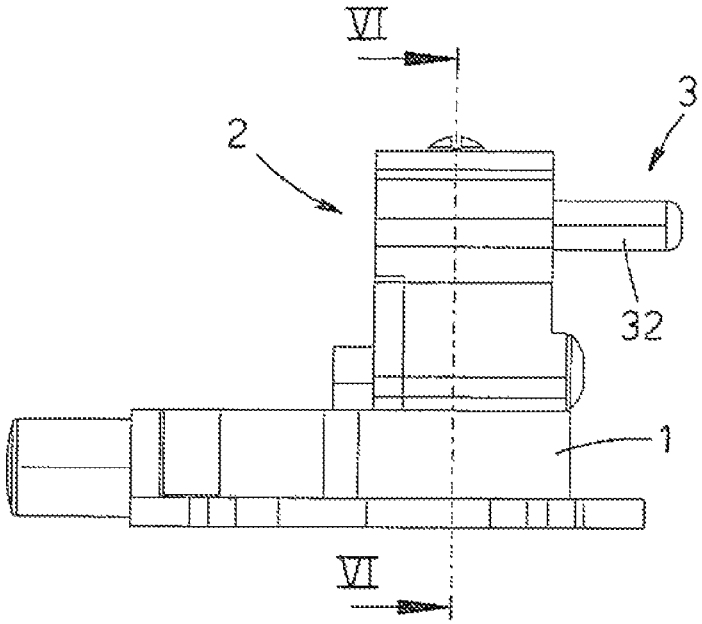

In particular, the elastic means 4 are stressable by a splaying of the pair of pins 32, with a consequent rotation of the pair of arms 31 with respect to the upper element 2, which splaying is determined by a lowering (schematically illustrated for example by the arrow denoted by P in FIG. 3) of the rear part of the boot onto the ski and by the inserting of the shaped portion present in the rear part between the pins 32.

Once the shaped portion has been completely inserted between them, the pins 32 are no longer in contact with the lateral walls of the shaped portion and are thus destined to be recalled by the elastic means 4 to near one another, with a consequent rotation of the pair of arms 31 with respect to the upper element 2, such as to lock against an upper part of the shaped portion and perform the hooking of the boot.

The upper element 2 is conformed such as to present an internal housing 21 in which the pair of arms 31 is positioned (see FIG. 2).

In particular, the upper element 2 exhibits a bottom 22, two lateral sides 28, 29, a front wall 23 (which faces the front part of the ski), a rear wall 26 and an upper wall 8 which define the above-mentioned internal housing 21.

The upper element 2 is coupled to the base element 1 in such a way that the bottom 22 of the internal housing 21 is parallel to the base element 1 and therefore also parallel to the ski.

In the illustrated embodiment of the figures, the bottom 22, the two lateral walls 28, 29, the front wall 23 and the upper wall 8 are realized in a single body while the rear wall 26 is fastenable/removable to and from the single body via fastening means.

The arms 31 of the pair of arms 31 are constrained to the bottom 22 of the internal housing 21 at a first end 33 thereof, such as to be rotatable in a perpendicular plane to the bottom 22, and therefore also perpendicular to the base element 1 and the ski.

The arms 31 exhibit, at a second end 34 thereof, through-holes 35 for positioning and fastening the pair of pins 32.

The pins 32 exhibit heads 36 at a first end thereof, the dimensions of which are larger than the through-holes 35 present in the second end 34 of the arms 31 such that the first ends of the pins 32 and therefore the heads 36 are housed internally of the internal housing 21.

The above-cited front wall 23 of the upper element 2 is specially provided with through-holes 24 of such a shape as to enable passage of the pins 32 such that they can project externally of the upper element 2.

The above-cited elastic means 4 are associated to the upper element 2 in such a way as to be in contact with the heads 36 of the pins 32 of the pair of pins 32.

In particular, as shown in the exploded view of FIG. 2 or in FIG. 6, the elastic means 4 comprise a spring 41 and a contact element 5 with the heads 36 of the pair of pins 32, the spring 41 and the contact element 5 being positioned internally of the internal housing 21 of the upper element 2.

A first end 42 of the spring 41 is inserted, through a through-hole 210 present in the bottom 22 of the internal housing 21, in a seating 11 provided in a threaded sleeve 110 which is positioned internally of a niche 12 present in the base element 1.

A second end 43 of the spring 41 is in turn inserted in a seating 51 which is afforded inferiorly in the contact element 5 (see FIG. 6, for example).

The heel-piece T comprises a screw (6) usable for regulating the degree of compression of the spring 41.

It is important to be able to adjust the degree of compression of the spring 41, as it determines the degree of stress required for performing the splaying of the pins 32, and consequently also the entity of the elastic recall force of the pins (32) and therefore the hooking force, once the shaped portion of the rear part of the boot has been inserted therebetween.

The above-mentioned screw 6 is inserted into the internal housing 21 through a through-hole 62 present in the upper wall 8 of the housing 21, and exhibits dimensions that are such as to cross both the contact element 5, via a relative through hole 61 present in the contact element 5 coaxially to the seating 51, and the spring 41, in such a way that the end can screw into the threaded sleeve 110.

In this way, by rotating the screw 6 the threaded sleeve 110 can be displaced (upwards or downwards, i.e. towards the upper element 2 or the base element 1) with a consequent changing of the degree of compression of the spring 41 (which is retained between the seating 51 of the contact element 5 and the seating 11 of the threaded sleeve 110).

The contact element 5 is provided with a pair of lateral wings 55, each of which is positioned inferiorly and contactingly with the heads 36 of the pair of pins 32.

The presence of the springs 41, the second end 43 of which, as mentioned above, is inserted in the seating (51) present inferiorly in the contact element 5, is such that the contact element 5, via the lateral wings 55 thereof, is always in contact with the heads 36 of the pins 32.

When the athlete has to hook the boots to the heel-piece T in order to begin a descent, he or she lowers the rear part of the boots such that the shaped portion thereof inserts between the pair of pins 32 and forces the pins 32 to splay from one another against the elastic force of the spring.

In more detail, the thrust exerted on the pins 32 by the shaped portion of the rear part of the boot forces the pins 32 to splay and move internally of the through-slots 24, and the arms 31 to rotate with respect to the first end 33 thereof constrained to the bottom 22 of the housing 21.

The pins 32, constrained by the thrust of the boot to splay, force the contact element 5 to lower into the housing 21, by means of the contact with the lateral wings 55, further compressing the spring 41.

Once the shaped portion of the rear part of the boot has been completely inserted between the pins 32, the pins 32 are no longer subject to any thrust causing splaying, and therefore the spring 41 is no longer compressed by the contact element 5: consequently the pins 32 are destined to be forced to near one another by the action of the spring 41, which pushes the element 5 upwards to lock against the upper part of the shaped portion, causing the boot to hook.

The above-cited rear wall 26 of the upper element 2 comprises a window 27 which enables the position assumed by the threaded sleeve 110 during the rotation of the screw 6 to be viewed from outside, and thus the degree of compression (preload) of the spring 41 can be observed.

The above-cited upper element 2 comprises, inferiorly of the bottom 22, a projection 13 having such a shape as to be insertable rotatably in the niche 12 present in the base element 1.

Further, the base element 1 exhibits a through-hole 15 for placing the niche 12 in communication with the outside, for positioning of an elastic organ 9 such that a first end of the elastic organ 9 is in contact with the projection 13 of the upper element 2 inserted in the niche 12 of the base element 1 and such that a second end of the elastic organ 9 is accessible externally and compressible by means of a regulating organ 91 associated to the second end.

The base element 1 is further provided with a window 18 at the through-hole 15 which enables external viewing of the degree of compression of the elastic organ 9 following the regulating performed thereon by the regulating organ 91.

From the above description it is clear that the heel-piece T of the present invention is provided with a particularly compact structure having a contained volume, and exhibits only the pair of pins 32 which project from the upper element 2, which pair of pins 32 is usable for hooking the boot.

Further, the pair of arms 31 and the elastic means 4 (the spring 41, the contact element 5) as well as the regulating screw for adjusting the degree of compression of the spring 41, are all contained within the internal housing 21 of the upper element 2, such that the heel-piece does not exhibit any posteriorly-projecting element, i.e. on the opposite side to the side facing towards the boot.

The structure of the hooking mechanism (the arms 31 constrained rotatably to the bottom 22 of the internal housing 21 of the upper element 2 and which bear the pins 32 which are subjected to the action of the spring 41 via the wings 55 of the element 5) enables a simple and immediate use by the athlete.

The components further exhibit small dimensions, as they are all situated, as described above, in the internal housing 21 of the upper element 2 of the heel-piece T, and therefore have a contained weight.

The above-described is intended by way of non-limiting example, and any eventual modifications in the details and/or design of the structure and/or arrangement of the various components constituting the heel-piece of the invention which might become necessary for technical and/or functional reasons are considered forthwith to fall within the ambit of protection defined in the following claims.

What is claimed:

1. A heel piece for an alpine ski attachment, comprising:

a base element (1), fastenable to a ski (S);

an upper element (2), coupled to the base element (1);

hooking means (3) borne by the upper element (2) for hooking to a shaped portion exhibited in a rear part of an alpine ski boot; wherein the hooking means (3) comprise a pair of arms (31), constrained to the upper element (2), said arms being rotatable with respect to the upper element (2), and a pair of pins (32) borne by the pair of arms (31), said pair of pins adapted to project from the upper element (2) and to face towards a front part (S1) of the ski (S) for hooking the ski boot;

elastic means (4) associated to the upper element (2), said elastic means adapted to be in contact with the pins (32) and to maintain the pins (32) at a predetermined reciprocal distance, said elastic means (4) being stressable by a separation of the pair of pins (32), with a consequent rotation of the pair of arms (31) with respect to the upper element (2), the separation being determined by a lowering of the rear part of the ski boot onto the ski and by insertion between the pins (32) of the shaped portion exhibited in said rear part, the pins (32) being destined, following complete insertion between the said pins (32) of the shaped portion, to be recalled by the elastic means (4) to near one another, with a consequent rotation of the pair of arms (31) with respect to the upper element (2), in order to lock against an upper part of the shaped portion and thus to hook the ski boot.

2. The heel piece of claim 1, wherein the upper element (2) exhibits a bottom (22), two lateral walls (28, 29), a front wall (23), a rear wall (26) and an upper wall (8) defining an internal housing (21) internally of which the pair of arms (31) is positioned.

3. The heel piece of claim 2, wherein the bottom (22), the two lateral walls (28, 29), the front wall (23) and the upper wall (8) of the upper element (2) are in a single body while the rear wall (26) is fastenable to/removable from the single body by fastening means.

4. The heel piece of claim 3, wherein the rear wall (26) of the upper element (2) comprises a window (27) for enabling a position assumed by the threaded sleeve (110) internally of the internal housing (21) to be seen from outside.

5. The heel piece of claim 2, wherein the arms (31) of said pair of arms (31) are constrained to the bottom (22) of the internal housing (21) at a first end (33) of the arms (31), the arms (31) being rotatable in a plane which is perpendicular to the bottom (22) and in that the arms (31) exhibit, at a second end (34) thereof, through-holes (35) for supporting the pair of pins (32), the pins (32) exhibiting at a first end thereof heads (36) which are larger than the through-holes (35) present in the second end (34) of the arms (31) of the pair of arms (31), such that the first ends of the pins (32), and therefore also the heads (36), can remain internally of the housing (21), and in that the front wall (23) is provided with through-slots (24) having such dimensions as to enable passage of the pins (32) such that the pins (32) can project externally of the upper element (2).

6. The heel piece of claim 5, wherein the elastic means (4) are associated to the upper element (2), the elastic means being in contact with the heads (36) of the pins (32) of the pair of pins (32).

7. The heel piece of claim 6, wherein the elastic means (4) comprise a spring (41) and a contact element (5) with the heads (36) of the pair of pins (32), said spring (41) and said contact element (5) being positioned in the internal housing (21) of the upper element (2), with a first end (42) of the spring (41) being inserted, through a through-hole (210) afforded in the bottom (22) of the internal housing (2), in a seating (11) afforded in a threaded sleeve (110) positioned internally of a niche (12) fashioned in the base element (1), and with a second end (43) of the spring (41) being inserted in a seating (51) fashioned inferiorly of said element (5), and further comprising a screw (6) for regulating a degree of compression of the spring (41), which is inserted in the internal housing (21) through a through-hole (62) afforded in the upper wall (8), the screw (6) exhibiting such dimensions as to cross both the contact element (5), through a relative through-hole (61) present therein, coaxially of the seating (51), and the spring (41), such that an end of the screw (6) can screw into the threaded sleeve (110), a rotation of the screw (6) determining a displacement of the threaded sleeve (110) internally of the internal housing so as to vary the degree of compression of the spring (41).

8. The heel piece of claim 7, wherein the contact element (5) comprises a pair of lateral wings (55), each of which is positioned inferiorly of and in contact with the heads (36) of the pair of pins (32).

9. The heel piece of claim 7, wherein the upper element (2) comprises, inferiorly of the bottom (22) of the internal housing (21), a projection (13) having such a shape as to be rotatably insertable in the niche (12) of the base element (1), the base element (1) exhibiting a through-hole (15) for placing the niche (12) in communication with outside due to positioning of an elastic element (9) in such a way that a first end of the elastic element (9) is in contact with the projection (13) of the upper element (2) inserted in the niche (12) of the base element (1), a second end of the elastic element (9) being externally accessible and compressible by means of a regulating means (91) associated to the second end.

10. The heel piece of claim 7, wherein the rear wall (26) of the upper element (2) comprises a window (27) for enabling a position assumed by the threaded sleeve (110) internally of the internal housing (21) to be seen from outside.

11. The heel piece of claim 9, wherein the base element (1) is provided with a window (18) at the through-hole (15) position in order to enable a degree of compression of the elastic element (9) to be seen from outside following a regulation on the said elastic element (9) by means of the regulating means (91).

* * * * *